US006854429B2

(12) United States Patent
Gelfand

(10) Patent No.: US 6,854,429 B2
(45) Date of Patent: Feb. 15, 2005

(54) ENGINE WITH DOUBLE SIDED PISTON

(76) Inventor: Vladimir Gelfand, 474 Anita Pl., Wheeling, IL (US) 60090

( * ) Notice: Subject to any disclaimer, the term of this patent is extended or adjusted under 35 U.S.C. 154(b) by 115 days.

(21) Appl. No.: 10/303,411

(22) Filed: Nov. 25, 2002

(65) Prior Publication Data

US 2004/0099229 A1 May 27, 2004

(51) Int. Cl.[7] ..... F02B 75/16
(52) U.S. Cl. ..... 123/61 R; 123/196 R
(58) Field of Search ..... 123/46 A, 63

(56) References Cited

U.S. PATENT DOCUMENTS

| | | | | | |
|---|---|---|---|---|---|
| 985,507 | A | | 2/1911 | Brown | |
| 1,412,833 | A | | 4/1922 | Blache | |
| 1,915,284 | A | | 6/1931 | Becker | |
| 1,922,393 | A | * | 8/1933 | Pielstick | 123/41.37 |
| 2,029,189 | A | | 1/1934 | Radloff | |
| 2,094,830 | A | * | 10/1937 | Clinton | 123/55.4 |
| 2,304,407 | A | * | 12/1942 | Hogan | 123/61 R |
| 2,317,167 | A | * | 4/1943 | Baer | 123/63 |
| 2,335,252 | A | * | 11/1943 | Appeman | 123/63 |
| 5,347,960 | A | * | 9/1994 | Tokumi | 123/63 |
| 5,526,779 | A | * | 6/1996 | Harrington | 123/61 R |
| 5,660,151 | A | * | 8/1997 | Yoshizawa | 123/63 |
| 5,816,202 | A | * | 10/1998 | Montresor | 123/61 R |
| 5,860,395 | A | | 1/1999 | Klotz et al. | |

FOREIGN PATENT DOCUMENTS

| | | |
|---|---|---|
| RU | 2161712 | 7/1996 |
| RU | 2174603 | 11/1996 |

* cited by examiner

*Primary Examiner*—Henry C. Yuen
*Assistant Examiner*—Jason Benton
(74) *Attorney, Agent, or Firm*—Mathew R. P. Perrone, Jr.

(57) ABSTRACT

An internal combustion engine has at least one cylinder, which is separated by a single dual-piston into two sub-chambers. The single dual-piston fulfills the role of two conventional pistons in its linear back and forth motion along the combustion chamber by using both its front and back surfaces as an element of a combustion chamber within the cylinder. Lubrication of the horizontally oriented engine distributes the oil into a space within the cylinder surrounding the middle of the dual-piston. The oil pump cycles oil to the required parts of the engine to an oil sump and back to the space.

17 Claims, 10 Drawing Sheets

ENGINE WITH DOUBLE SIDED PISTON

This invention relates to an engine, and more particularly to an engine having a horizontal stroke of its double sided piston, from which power may be taken.

BACKGROUND OF THE INVENTION

Even with the awareness of the public regarding the need for powerful engines, which may be run efficiently, thereby using scarce fuel more effectively, substantial progress has yet to be made. Power and efficiency are substantially contradictory terms. A powerful engine does not have fuel efficiency. A fuel efficient engine usually lacks power.

A large number of parts go into a typical vehicle engine. While these parts are necessary to complete the engine, such parts add to the complexity of the engine. Yet the parts are necessary to achieve the desired results. If the number is reduced while maintaining the desired power ratio, great advantages can be achieved.

One attempt to maintain a set of desired engine qualities while simplifying the engine structure, is commonly known as a rotary engine. While the rotary engine provides a good power to weight ratio and shows great initial promise, it lacks the required durability.

Commonly, most vehicle engines run on fossil fuel. Combustion of the fossil fuel adds greatly to the pollution of the air and the ground. Other adverse effects of such combustion are also well documented.

For example, smog around large cities is mainly attributed to the internal combustion engine. Such smog has an extremely adverse effect on the health of people in and around the city. If this pollution can be reduced, so can the adverse effects of smog. If minimal change is required in order to accomplish pollution reduction, such an action renders the solution much more acceptable.

In order to reduce the use of fossil fuel, hybrid engines are coming into play. These engines switch back and forth between electrical power and fossil fuel power. Such a structure adds to the complexity of the vehicle and increases the chances for a malfunction. Thus, hybrid engines do not answer the required questions.

One of the problems with replacement engines, is that the gasoline in particular has a substantial amount of energy. For example, one gallon of gasoline with a weight of about three kilograms stores as much energy as 325 kilograms of batteries. Thus, electrically powered vehicles are complicated matters. These complicated vehicles are provided in order to reduce outside emissions and improve mileage. However, such advantages are not efficiently accomplished.

Also, with an engine, power is usually directly proportional to size. If an engine has a large cylindrical displacement and size, it generally has a capability of producing substantial power. If an engine has a small cylindrical displacement and size, it generally has a capability of producing less power. It is very desirable to produce power with a smaller engine.

Combining a smaller engine with sufficient power can lead to fuel efficiency. However, this combination is not technically feasible. The more powerful engines have a greater number of parts, and poor efficiency. It is extremely difficult to achieve both efficiency and power in an engine.

Attempts to make engines more efficient are not completely successful. Some of the attempts include adding various electronic or computer controls to an existing engine. Such additions do not give the major increases in efficiency and reduce fuel consumption as much as is desirable.

SUMMARY OF THE INVENTION

Among the many objectives of this invention is the provision of an engine having two simultaneous piston strokes in one cylinder.

A further objective of this invention is the provision of an engine having substantial power.

A still further objective of this invention is the provision of an engine having a small size when compared to an existing engine of the same capacity.

Yet a further objective of this invention is the provision of engine having fuel efficiency.

Also, an objective of this invention is the provision of an engine having reduced pollution.

Another objective of this invention is the provision of an engine having a reduced number of parts.

Yet another objective of this invention is the provision of engine having reduced size.

Still, another objective of this invention is the provision of engine having reduced weight.

A further objective of this invention is the provision of engine having an improved power to weight ratio.

These and other objectives of the invention (which other objectives become clear by consideration of the specification, claims and drawings as a whole) are met by providing an engine with a double sided piston mounted in a cylinder being activated on each end of the cylinder by a spark plug mounted at each end of the cylinder.

BRIEF DESCRIPTION OF THE DRAWINGS

Throughout the figures of the drawings, where the same part appears in more than one figure of the drawings, the same number is applied thereto.

DESCRIPTION OF THE PREFERRED EMBODIMENTS

Figure 1:
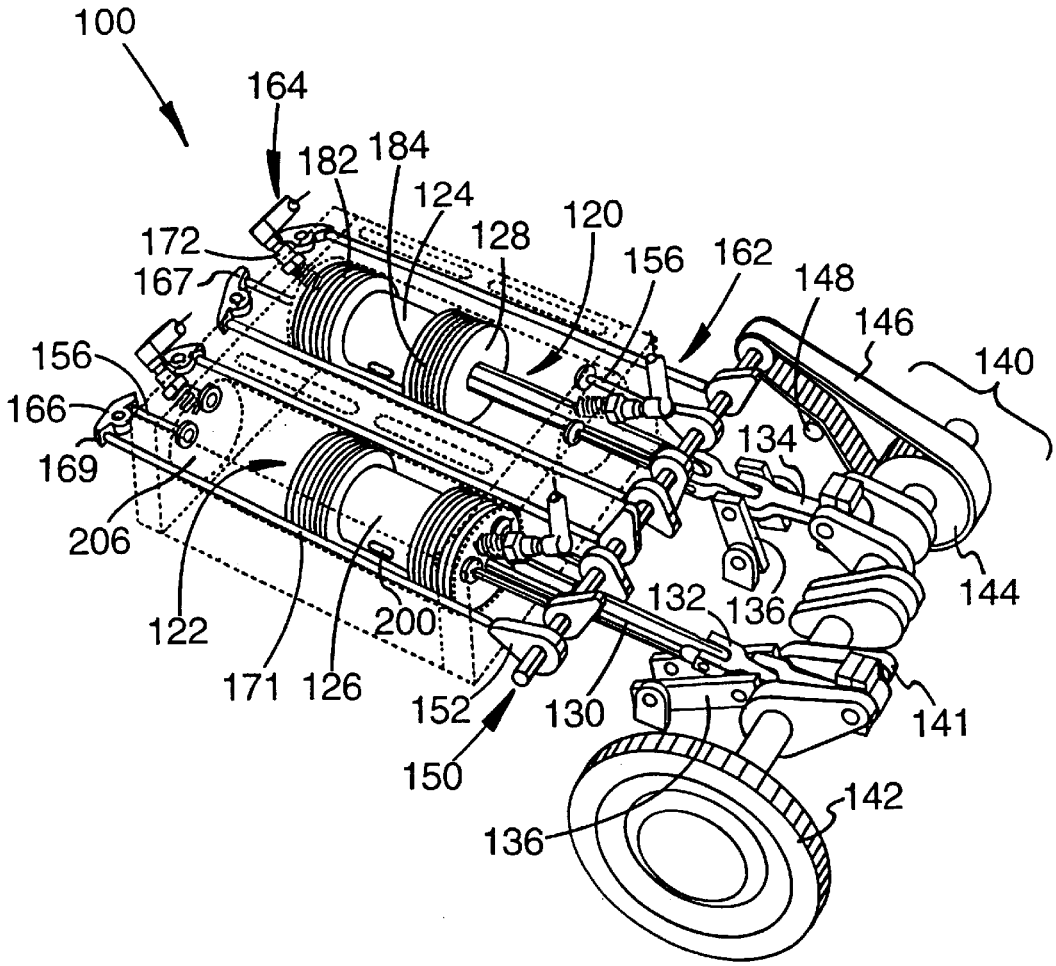
FIG. 1 depicts a perspective view of the double sided piston engine 100 of this invention, in partial cross-section.
Figure 2:
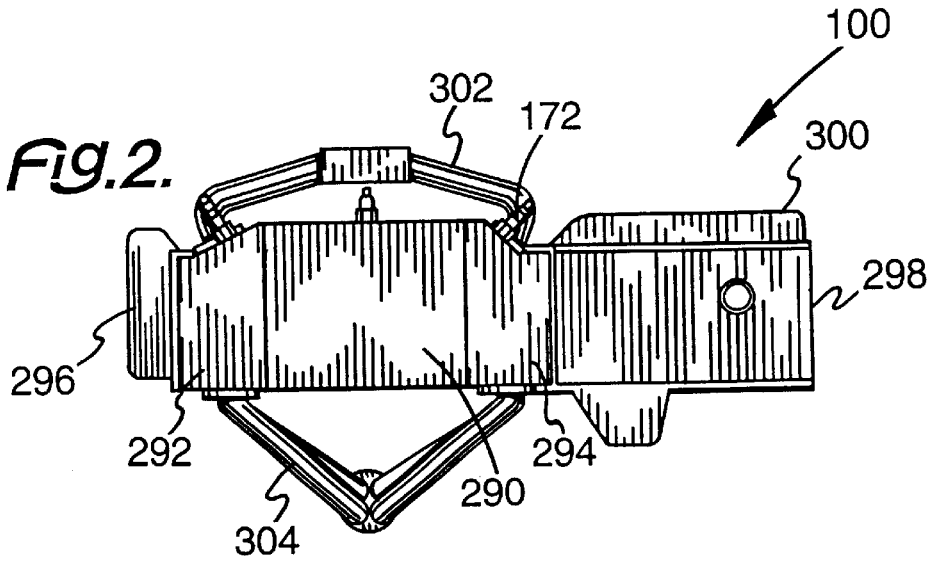
FIG. 2 depicts a side, profile view of the double sided piston engine 100 of this invention.
Figure 3:
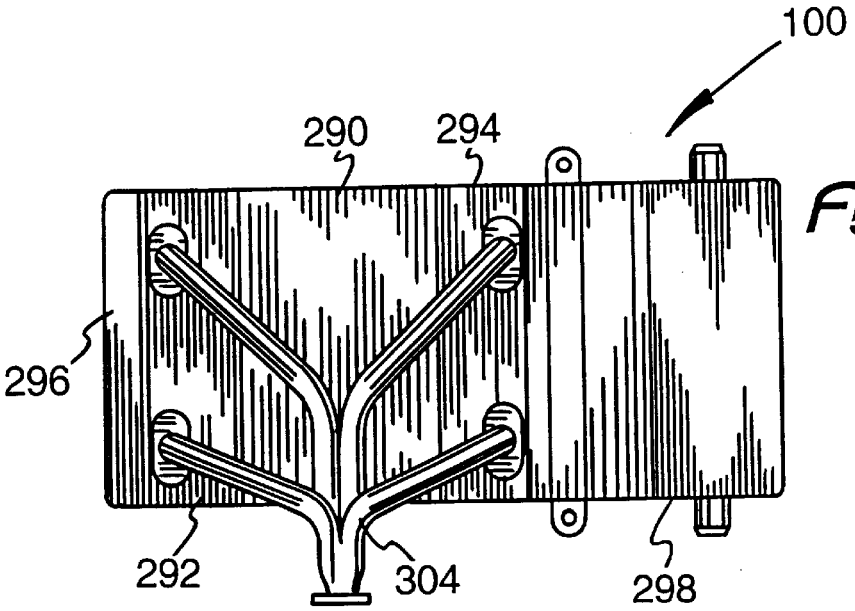
FIG. 3 depicts a bottom plan view of the double sided piston engine 100 of this invention.
Figure 4:
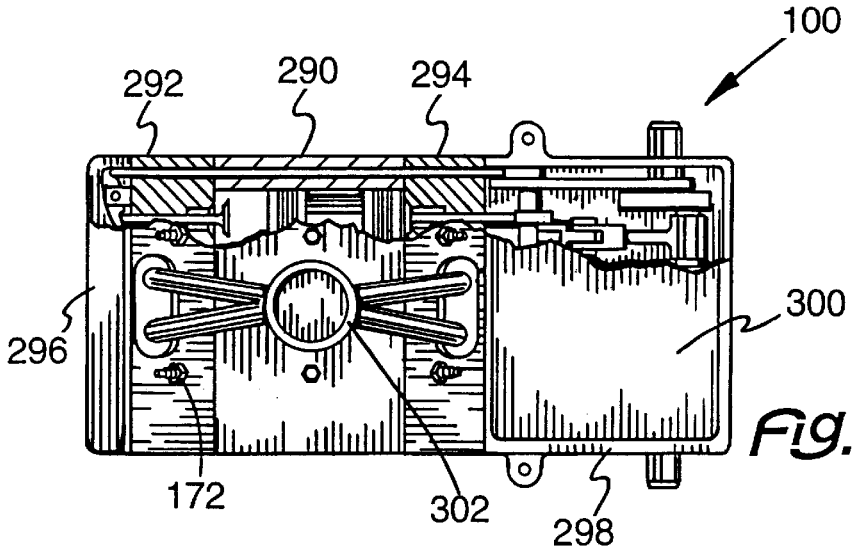
FIG. 4 depicts a top plan view of the double sided piston engine 100 of this invention in partial cross-section.
Figure 5:
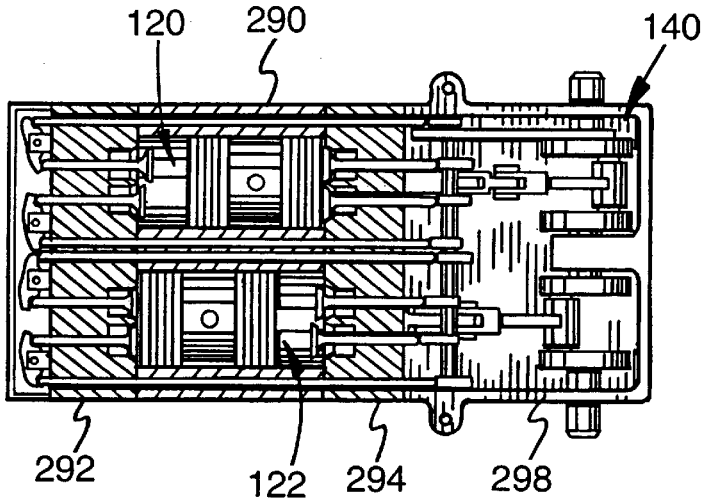
FIG. 5 depicts a top plan view of the double sided piston engine 100 of this invention, in full cross-section.

In the engine of this invention, the cylinder contains the double sided piston. Each side of the piston is propelled by a self-contained explosion or internal combustion within the cylinder, caused by a spark from its own spark plug within the same cylinder at opposing ends of that cylinder. Centrally located on the piston is a recessed portion adapted to receive an oil flow. Thus, with piston ring seals at both ends of piston, lubrication of the engine in general, and that cylinder in particular, occurs efficiently during the firing of or discharge from the spark plug.

This internal combustion engine entails one cylinder, separated into two combustion chambers by a single dual piston or double sided piston, thereby providing two combustion chambers within a single cylinder. Dual or double sided are used interchangeably to define the piston. Each of those two combustion chambers may be referred as a sub-chamber. Thus, one cylinder serves the function of two separate cylinders in a standard internal combustion engine.

The single dual piston essentially fulfills the role of two conventional pistons in its linear back and forth motion along the combustion chamber. The dual piston is able to accomplish the role of two conventional pistons by using both its front and back surfaces (in other words, both ends of the dual piston), the latter being attached to the connecting rod.

Because the motion of the connecting rod is substantially linear, the rod can penetrate an end nearest cylinder while still keeping the cylinder closed off by means of a sealant-bushing. Ultimately, a single stroke of the dual piston simultaneously accomplishes two separate steps of two different and separate combustion chambers, all within the same cylinder.

In other words, this design for the internal combustion engine entails a single combustion chamber that essentially serves as two separate cylinders in the form of two sub-chambers for combustion within a single cylinder. The cylinder is separated into two combustion chambers by a single dual piston. The single dual piston essentially fulfills the role of two conventional pistons in its linear back and forth motion along the axis of the combustion chamber.

The piston basically has a horizontal stroke with dual valves on each end of the cylinder. A pushrod is connected to a rocker arm with the rocker arm being mounted on one end of the cylinder, which contains the piston. In turn, mounted on the end of the piston oppositely disposed from the rocker arm is the piston rod.

In the internal combustion engine of this invention, compression is much easier for the engine because as one sub-chamber combusts, the energy from the explosion is used directly to compress the fuel in the second sub-chamber. So instead of transferring force from a first piston to a first connecting rod and then to the crankshaft, followed by a force transfer to second connecting rod and then to a second piston (which is a complex and inefficient method), the force is transferred directly from one end of the dual-piston to the other end of the dual-piston. There is only one engine component, that is the dual-piston, involved in the force or energy transfer, as opposed to the existing method which involves multiple parts.

While it is not desired to be bound by any particular theory for the effectiveness of the, engine herein, the following postulate is offered. The horizontal stroke provides a more efficient force vector than does the vertical or angular stroke of the prior art engines. The horizontal stroke provides a more efficient use of force and requires greatly reduced energy to overcome the inertia of the vertical or angular stroke.

With such efficiency, fuel of different types and qualities may be used. Thus, while gasoline or any other fossil fuel may be used with this engine, the more efficient use of vectors allows the use of a fuel, which is less complicated to manufacture and causes less pollution. The dual piston reciprocates in linear motion along its central axis. This allows for a more direct, and therefore, more efficient transfer of force and energy between the two ends of the dual piston. This is not the case in the conventional engine where the force and energy are transferred tangentially, that is to say at an angle.

On the end of the piston rod opposed to the piston, the piston rod is connected to a crankshaft through a stabilizer yoke. This stabilizer yoke is connected to a power yoke. The power yoke and the stabilizer yoke are both connected to a stabilizer damper. At its base, the power yoke is connected to the crankshaft.

The rocker arm connects an engine valve to the pushrod, with the pushrod being connected at the opposing end right to the camshaft in order to achieve the desired power results. With the dual valves on each end of the cylinder and the piston connected with a yoke assembly to the crankshaft, great efficiency is achieved.

The engine block must support each piston in its respective cylinder. As many cylinders as desired may be supported in an engine block, if the engine has the appropriate size and structure therefor. Given the piston structure described herein, the block adjustments can be determined. The exhaust manifold is positioned over the block between the outboard head and the inboard head. The crankcase cover cooperates with the structure to support the engine block and permits mounting of the engine in a vehicle as desired. Intake manifolds on both ends connect and provide an air intake at both ends of this engine block, for the piston or pistons therein.

With the crank case covering the crankshaft of the crankcase assembly, the engine process may proceed efficiently. On the bottom of the block is connected the gas exhaust manifold. The crankcase supports the crankshaft and permits efficient operation thereof. The rocker cover provides protection or sealing for the opposing end of the cylinder and achieves the desired results.

Within the cylinder in general and the engine block in particular can be a water jacket, which both permits the intake of water or other coolant from a radiator or other source, and provides cooling for the engine. The intake manifold allows the air to be in the right position to permit the proper explosion within the cylinder, in order to provide efficient use of the engine.

With a four-stroke engine of this invention having two cylinders and using two dual pistons, there are four combustion chambers, two for each cylinder. The first combustion chamber in the first cylinder has an intake stroke, while a fourth combustion chamber in the second cylinder has an exhaust stroke. As the second combustion chamber of the first cylinder is oppositely disposed from the first combustion chamber, while the first combustion chamber has a power stroke, the second combustion chamber has an exhaust stroke.

Assuming that the engine has two dual pistons, the third combustion chamber is oppositely disposed from a fourth combustion chamber. As the fourth combustion chamber has an exhaust stroke, the third combustion chamber has a power stroke. First combustion chamber and second combustion chamber are made to be coordinated themselves along with mutual coordination of the fourth combustion chamber and the third combustion chamber.

With this horizontal stroking and the appropriate attachments to the camshaft and the drive shaft, great engine efficiency is achieved. Not only are the engine structures disclosed herein more efficient, the particular fuel consumption is greatly reduced, while still maintaining an advantageous engine power to weight ratio and providing a substantial size reduction over the standard engines of the prior art.

This new design also demands a new method of lubrication. Since the engine is oriented horizontally, with the dual pistons moving parallel to the ground, the oil is distributed in a different manner. The new oil lubrication design allows for a more efficient distribution of oil and it increases the heat exchange ratio within the connecting rod, thus increasing the reliability and lifetime of the connecting rod.

Oil is pumped into a space surrounding the middle of the dual piston. When the space is roughly half-filled with oil, the oil next travels through a drain aperture in the dual piston, then through an axial channel in the dual piston, then through an axial channel in the connecting rod, then through a drain aperture in the bottom of the connecting rod and out into the oil sump which is located outside the combustion chamber. From there, the oil is collected and redistributed by the oil pump.

The engine of this invention still employs the reciprocating internal combustion process of the prior art engine. The same four steps of the engine cycle still exist; that is to say intake, compression, combustion, and exhaust. However, the engine of this invention is able to simultaneously accomplish two engine cycles. In a single stroke of a single dual piston engine in a single chamber, the engine completes two separate steps of the engine cycle (also known as the Otto cycle), which requires two different cylinders in engines of the prior art.

The engine of this invention has a set of dual pistons connected to the crankshaft with a set of connecting rods. Each dual piston divides the cylinder into two separate combustion chambers or sub-chambers, one in front of the dual piston and one behind the dual piston. As the dual piston reciprocates, it is fulfilling a step in the cycles of what normally require two cylinders and two pistons with one piston and one cylinder. As a result of this design, one cylinder contains part of the connecting rod. The connecting rod leaves the cylinder through an aperture that will be sealed around the connecting rod while allowing free movement of the rod, preferably with a slide fitting bushing.

Unlike the conventional engine, in which the connecting rod connects the single-piston directly to the crankshaft, the engine of this invention has two new parts that go between the rod connector and the crankshaft. The part that connects directly to the crankshaft is called the connecting shaft. One end of the connecting shaft is affixed to the crankshaft by means of a rod bearing or babbitt bearing and it moves just like the end of the conventional connecting rod in the existing engine.

The other end of the connecting shaft is attached to the clevises link by means of a dowel pin. The clevises link goes between the connecting rod and the connecting shaft. With the clevises link applied in this fashion, it helps convert the linear motion of the dual piston and connecting rod into the rotational motion of the crankshaft.

The support lever attaches at the same hinge where the clevises link meets the connecting shaft. The support lever leads from the hinge down to the needle bearing. The purpose of the support lever is to allow for the full rotation of the crankshaft. The needle bearing permits the relatively small angular oscillation of the support lever. Thus, there are three parts between the dual piston and the crankshaft. The dual piston attaches to the connecting rod, which connects to the clevises link, which connects to the connecting shaft, which connects to the crankshaft.

The two extra parts are necessary because they allow for a perfectly linear reciprocation of the dual piston and connecting rod. Because the force of combustion within the cylinders is used to move the dual piston and connecting rod along a line, the entire force does useful work by rotating the crankshaft. In the conventional engine, the piston's motion is linear but the connecting rod's motion is always at an angle to the vertical (the vertical is the central axis of the piston).

As a result, some of the force is wasted on swinging the end of the connecting rod instead of using it to rotate the crankshaft. From a physical point of view, it is a simple matter of vectors. In the conventional engine, the combustion force vector points in the direction of the connecting rod. Since the rod is off at an angle to the vertical, one component of the force goes along the vertical and is used to rotate the crankshaft but the perpendicular component of the force is used merely to rotate the end of the connecting rod. This perpendicular component of the force is wasted.

In the engine of this invention, the force vector points in the direction of the connecting rod just as it did in the conventional engine. But since the connecting rod reciprocates along the axis, the force vector points directly along the axis as well. The force is entirely parallel to the axis, meaning that there is no perpendicular component, and thus no wasted force.

The engine prefers a new lubrication process. Although the engine of this invention works under both vertical and horizontal orientations, the following description of the lubrication process applies to the horizontal orientation. The engine of this invention is using a dual piston, which is different from the conventional single-piston.

The cross-sectional design for the dual piston is still cylindrical but the diameter of the dual piston changes along its central axis. The middle section of the dual piston is narrower than its ends so it resembles a dumbbell. This creates a space between the combustion chamber and the middle of the dual piston.

The dual piston has a set of piston rings on each end, such that each end is substantially equal in diameter to the other end. However, the central portion of the piston has a diameter less than the diameter of the ends. While it is preferred that the central portion of the piston be cylindrical, the key function of the central portion is to support each of the piston ends. To that end, the central portion may be of a desired shape, so long as the piston ends are supported.

Preferably, the diameter of the cylindrical central portion is about ninety five (95%) percent up to about one hundred (100%) percent of the diameter of the ends. More preferably, the diameter of the central portion is about ninety six (96%) percent up to about one hundred (100%) percent of the diameter of the ends. Most preferably, the diameter of the central portion is about ninety seven (97%) percent up to about one hundred (100%) percent of the diameter of the ends.

Above the chamber is an oil pipe pressure, which pumps oil into the empty space in the middle of the dual piston. As the oil is pumped into the space, it drips along the sides of the dual piston (the part of the dual piston that is narrower than the rest) and collects on the bottom of the recess. As more oil is pumped in, the oil level rises. About halfway up, the dual piston has an aperture in it to allow the oil to leave the recess (just like most sinks have an aperture near the top to prevent overflowing). The part of the dual piston's axis that goes from the middle to the connecting rod is hollowed out, creating an axial channel. The aperture in the dual piston leads to this hollow channel. The hollow channel leads to the connecting rod, which is also hollowed-out along its central axis. Thus, the oil can flow from the aperture in the dual piston, through the dual piston's channel, and through the channel within the connecting rod. There is an aperture in the bottom of the connecting rod outside the combustion chamber. When the oil reaches the outside of the combustion chamber, it drips out of the aperture in the connecting rod and into the oil sump that is located directly underneath. The oil pump then collects the oil from the oil sump, sends it through the oil filter, and delivers it to the oil reservoir above the combustion chamber, where the cyclical lubrication process will start again.

With the structure of the piston and the lubrication of the central portion of the piston, starting of the engine becomes more efficient. Because this structure keeps more oil or lubrication around the piston, even after the engine shutdown, more oil is present for more immediate lubrication when the engine again restarts. In this fashion, there is less wear and tear on the engine of this invention, when compared to a conventional engine.

Because this engine has the horizontal stroke and does not use as much force to overcome undesirable force vectors, this engine has less vibration and provides for a more quiet performance. As such vibration is a waste of energy, the horizontal stroke for this engine becomes more efficient.

In addition, with the double sided piston, being fired on both ends, compression is improved. Compression in an internal combustion engine causes the most resistance on the crankshaft, the connecting rod, and the piston. With the double sided piston, as one side fires, the other side moves and compresses the fuel and air mixture. Force is transferred directly from one end to the other end of the piston, with greatly reduced stress on the crankshaft, the connecting rod, and the piston. Thus, the compression becomes more efficient with the resulting more efficient engine.

This structure for engine also achieves better cylinder wall wear conditions. The cylinder wall of this invention wears evenly, while the cylinder wall of a conventional engine with a single sided piston wears more in the combustion chamber area. Such even wear extends the life of the engine and offers more steady control of the compression.

Such improved controls and efficiency reduce pollution. Thus, this particular engine provides the advantages of a tremendous power to weight ratio improvement, with improved efficiency.

Referring now to FIG. 1, a double-sided piston engine 100 of this invention may have any number of cylinders. This model of double sided piston engine 100 has a first cylinder 120 and a second cylinder 122, in which are mounted first piston 124 and second piston 126. Each of pistons 124 and 126 are double sided in that a spark plug 172 is mounted on both sides of first cylinder 120 and second cylinder 122. Thus, both first piston 124 and second piston 126 have a firing spark plug 172 adjacent each side thereof and are moved thereby.

Each of pistons 124 and 126 has a rod end 128 with piston rod 130 mounted thereon. The piston rod 130 is connected to a stabilizer yoke 132, which is in turn connected to a power yoke 134. A stabilizer damper 136 is connected to both the power yoke 134 and the stabilizer yoke 132.

Also, from the power yoke 134 is a connection to crankshaft 141. At one end of the crankshaft assembly 140 is flywheel 142. On the other end of crankshaft assembly 140, oppositely disposed from flywheel 142 is timing wheel 144. Around timing wheel 144 is timing belt 146, which connects crankshaft assembly 140 to camshaft assembly 150. Camshaft assembly 150, in this embodiment, has eight cams 152 mounted thereon, in order to operate two valves 156 for each of first cylinder 120 and second cylinder 122. Thus, there are eight valves 156 in the depicted here.

In contact with the timing belt 146 is a belt tension device 148. The belt tension device 148 is used in a standard fashion to adjust the tension on timing belt 146. The flywheel 142 is on the crankshaft assembly 140, but is oppositely disposed from timing wheel 144, which is a standard design suitable for use with the double sided piston engine 100 of this invention.

Each of first cylinder 120 and second cylinder 122 has a rod end 162 oppositely disposed from a rocker arm end 164. At rocker arm end 164, four of rocker arm 166 are connected, each to a valve 156 at the inside pivot side 167, while at the outside pivot side 169, each rocker arm 166 is attached to a pushrod 171. Pushrod 171 is contacted at the opposite end by one of cams 152 on camshaft 154 of camshaft assembly 150.

At rod end 162 for each of first cylinder 120 and second cylinder 122 are two valves 156. Thus, the valves 156 are eight in number in this embodiment. Each of the eight of valves 156 is contacted directly or indirectly by a cam 152, also on camshaft 154 of camshaft assembly 150.

Each pair of valves 156 on rod end 162 and each pair of valves 156 on rocker end 164 have a spark plug 172 cooperating therewith. Each member of a pair of the spark plug 172 are positioned in opposing ends of a first cylinder 120 and second cylinder 122.

While first cylinder 120 has first piston 124 slidably mounted therein and second cylinder 120 has second piston 126 slidably mounted therein, only first piston 124 need be discussed here, because its movement and structure are similar to and coordinated with second piston 126. First piston 124 is cylindrical in nature and has first piston rings 182 mounted thereon adjacent to rocker arm end 164 and second piston rings 184 mounted thereon adjacent to rod end 162.

Figure 7:
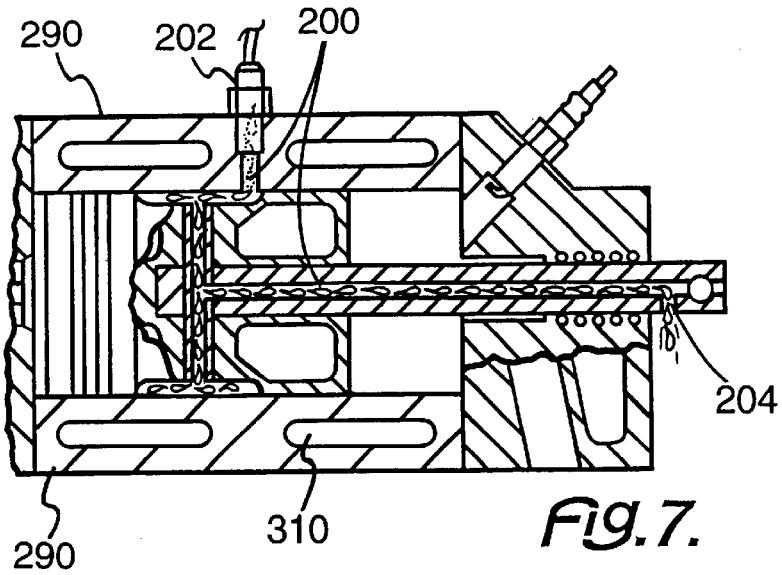
FIG. 7 depicts a side view of the double sided piston engine 100 of this invention, in partial cross-section, showing first internal oil flow system 200.

Between first piston ring assembly 182 and second piston ring assembly 184 is a first internal oil flow system 200 (shown in FIG. 7). Oil aperture 202 (shown in FIG. 7) in cylinder 120 permits oil (not shown) to lubricate both cylinder 120 and its corresponding piston. Piston movement and piston rings for first piston 124 and second piston 126 keep oil out of the spark plug or combustion chambers 206. Thus, with first piston 124 in first cylinder 120 and second piston 126 in second cylinder 122, there are two combustion chambers 206 in cylinders 120 and 122.

Adding FIG. 2, FIG. 3, FIG. 4, and FIG. 5 to the consideration, the engine block 290 contains first cylinder 120 and second cylinder 122 with the appropriate exterior requirements for an engine. On engine block 290 is an outboard head cover 292 and inboard head cover 294. The rocker cover 296 is secured adjacent to outboard head cover 292. Crankcase 298 is secured to inboard head cover 294. The crankshaft assembly 140 passes through crankcase 298 and is lubricated by the oil therein. Crankcase 298 has a cover 300 thereon.

Intake manifold 302 straddles engine block 290 and is connected at each end to outboard head cover 292 and inboard head cover 294. Oppositely disposed from intake manifold 302 and straddling engine block 290 is exhaust manifold 304. In a like fashion as intake manifold 302, exhaust manifold also straddles engine block 290.

Appropriately mounted on outboard head cover 292 and inboard head cover 294 are spark plugs 172 adapted to fire both ends of the same piston in a proper order. With this structure, it becomes clear how efficient double sided piston engine 100 is.

Figure 6:
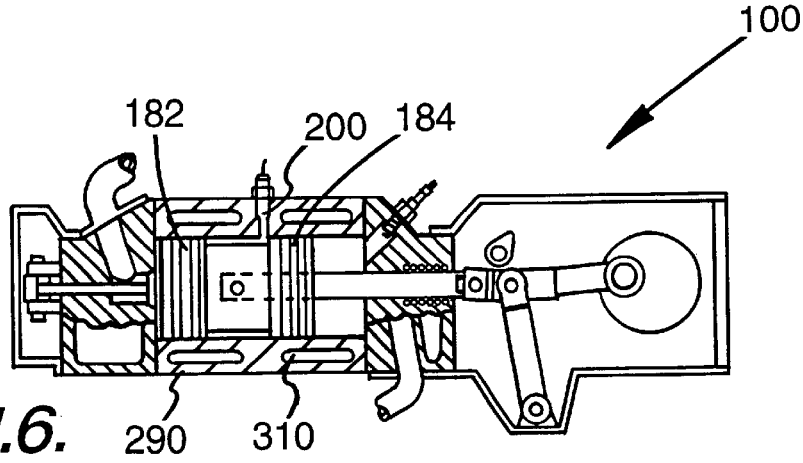
FIG. 6 depicts a side view of the double sided piston engine 100 of this invention, in partial cross-section.

With addition of FIG. 6, and FIG. 7, the cooling mechanism 310 of double sided piston engine 100 becomes clear. Cooling mechanism 310 includes a water jacket 312 within the engine block 290. Water, antifreeze, or combinations thereof flow through a water jacket 312 and cooperate with first internal oil flow system 200, in order to efficiently cool the engine 100.

First internal oil flow system 200 includes oil intake port 202 in engine block 290. Oil passes through oil intake port 202 into either first cylinder 120 or second cylinder 122, and provides lubrication therefor between first piston rings 182 and second piston rings 184. Oil exit port 204 permits oil to pass out of engine block 290, and pass through the engine cycle again.

For an understanding of the operation of double sided piston engine 100; FIG. 8, FIG. 9, FIG. 10 and FIG. 11 must be considered together. First piston 124 and second piston 126 are each moved by coordinated firing of a pair of spark plug 172. Each pair of spark plug 172 are at opposing ends of each of first piston 124 and second piston 126 as shown in FIG. 1.

Figure 8:
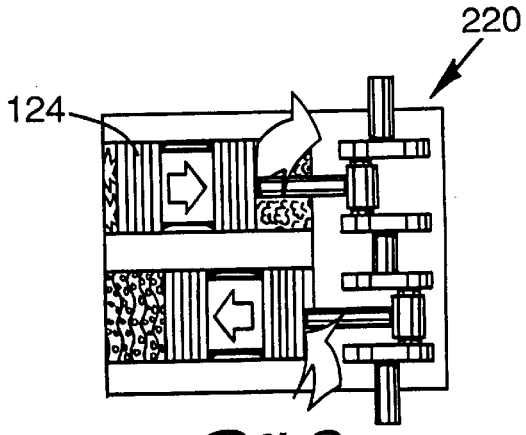
FIG. 8 depicts a top, partially cross-sectioned view of the double sided piston engine 100 of this invention, in partial cross-section, showing the first cycle 220.
Figure 9:
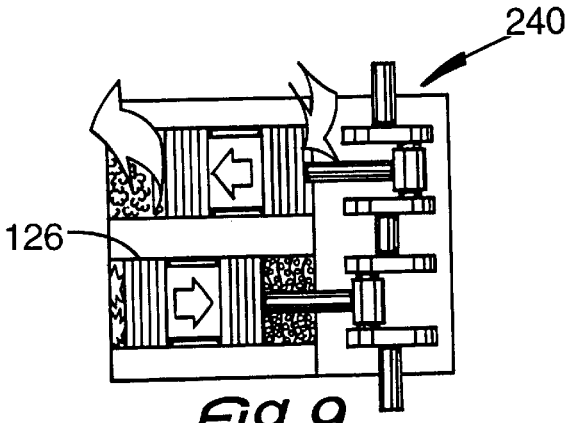
FIG. 9 depicts a top, partially cross-sectioned view of the double sided piston engine 100 of this invention, in partial cross-section, showing the second cycle 240.
Figure 10:
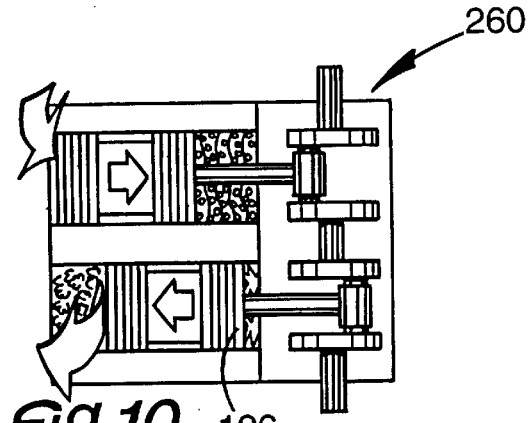
FIG. 10 depicts a top, partially cross-sectioned view of the double sided piston engine 100 of this invention, in partial cross-section, showing the third cycle 260.
Figure 11:
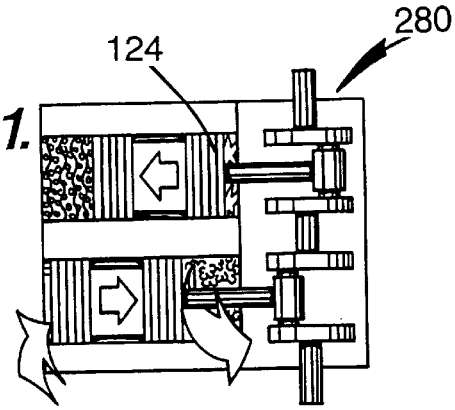
FIG. 11 depicts a top, partially cross-sectioned view of the double sided piston engine 100 of this invention, in partial cross-section, showing the fourth cycle 280.

FIG. 8 depicts first cycle 220 as spark plug 172, at outboard head cover 292 (FIG. 2) and adjacent to first piston 124, fires for a power stroke. Secondly, FIG. 9 depicts second cycle 240 as spark plug 172 at outboard head cover 292 and adjacent to second piston 126 and inboard head cover 294 fires for a power stroke. Thirdly, FIG. 10 depicts third cycle 260 as spark plug 172 at inboard head cover 294 (FIG. 2) and adjacent to second-piston 126 fires for a power stroke. Finally, FIG. 11 depicts fourth cycle 280 as spark plug 172 at inboard head cover 294 and adjacent to first piston 124 fires for a power stroke. The sequence is repeated for as long as it is desired to run the engine 100.

Figure 12:
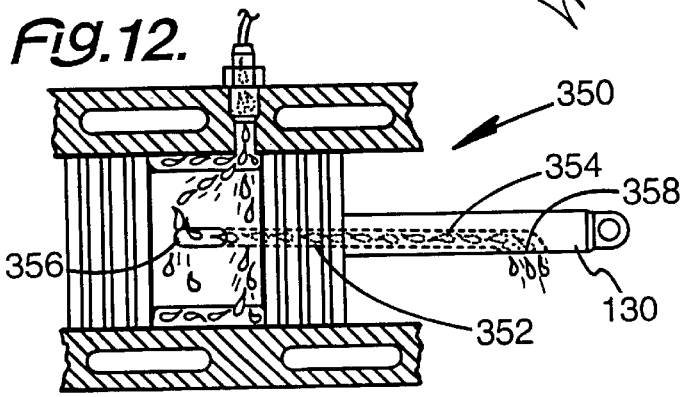
FIG. 12 depicts a side view of the double sided piston engine 100 of this invention, in partial cross-section, showing second internal oil flow system 350.

In FIG. 12, second internal oil flow system 350 differs from first internal oil flow system 200, in that first piston 124 or second piston 126 may have a hollow piston core 352 communicating with arced hollow rod core 354 for piston rod 130. This eliminates the need for oil exit port 204 by providing a piston aperture 356 communicating with hollow piston core 352. Rod aperture 358 replaces oil exit port 204.

Figure 13:
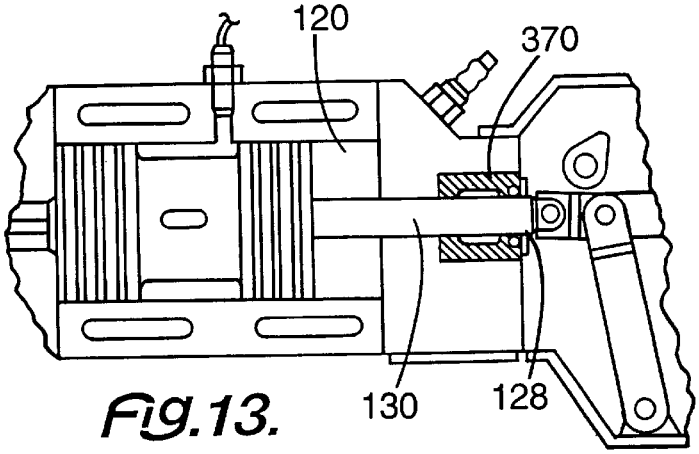
FIG. 13 depicts a perspective view of the single piston engine 450 of this invention, with rod bushing 490.

An additional modification is shown in FIG. 13 in that a cylinder, such as first cylinder 120, may have a bushing 370 in rod end 128 in order to provide support for piston rod 130 within cylinder 120. Clearly this structure may be applied to other cylinders also.

Figure 14:
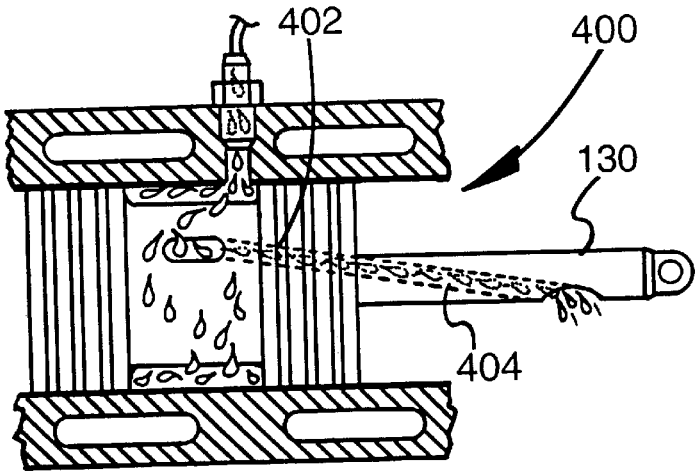
FIG. 14 depicts a side view of the double sided piston engine 100 of this invention, in partial cross-section, showing third internal oil flow system 400.

FIG. 14 depicts third internal oil flow system 400. Third internal oil flow system 400 differs from the second internal oil flow system 350 in that arced core piston 402 is used instead of straight hollow core piston 352. The arced core piston 402 communicates with a slot 404 in piston rod 130. The slot 404 combined with the straight hollow core piston 402 is believed to permit a smoother flow of oil through engine 100.

Figure 15:
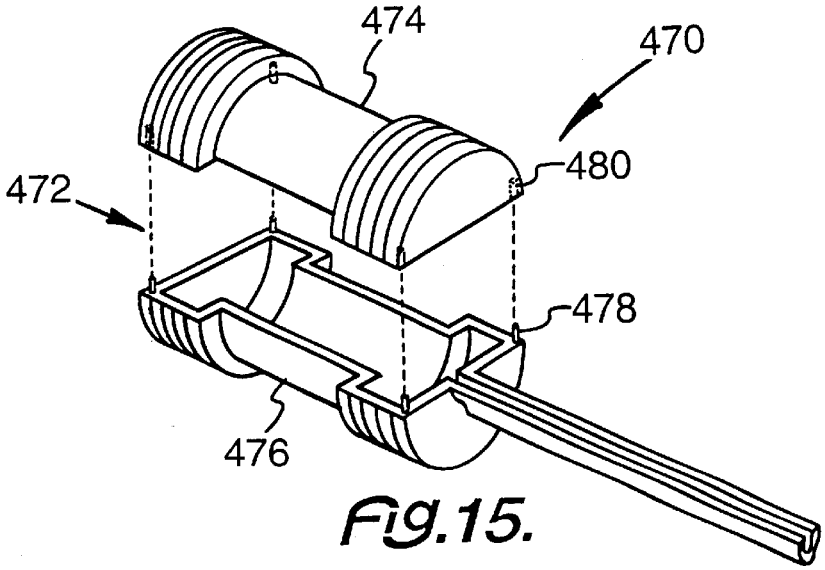
FIG. 15 depicts a perspective view of the single double sided piston engine 450 of this invention, in partial cross-section, showing halved piston assembly 470.

With FIG. 15, halved piston assembly 470 may apply to any piston of this invention, including but not limited to, first piston 124. Halved piston assembly 470 has a shape similar to first piston 124. Halved piston assembly 470 may be hollow or solid as desired. If it is hollow, second internal oil flow system 350 or third internal oil flow system 400 are used therewith.

Halved piston assembly 470 is formed along the cylindrical axis 472 and provides a top piston half 474 and a bottom piston half 476. Bottom piston half 476 has alignment pins 478 thereon at each corner thereof. Top piston half 474 has corresponding pin receivers 480 for each of alignment pins 478 in order to permit proper alignment of top piston half 474 and a bottom piston half 476.

First piston rings 182 (shown in FIG. 1) and second piston rings 184 (shown in FIG. 1) cooperate with alignment pins 478 and pin receivers 480 to hold top piston half 474 and a bottom piston half 476 together and form a piston such as first piston 124. Halved piston assembly 470 provides a desired manufacturing process for engine 100.

Figure 16:
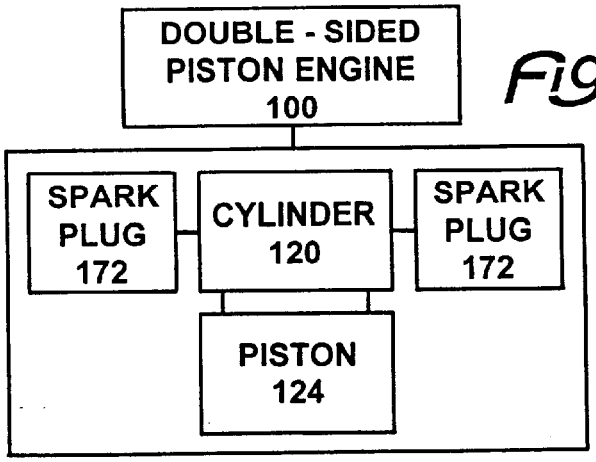
FIG. 16 depicts a block diagram of the double sided piston engine 100 of this invention.

Referring now to FIG. 16, a double sided piston engine 100 has a cylinder such as first cylinder 120 with a piston such as first piston 124 mounted therein. A spark plug 172 fire at each end of first cylinder 120, so that the first piston 124 is moved by explosions caused by two different spark plugs. As is clear from this Figure and the teachings in the remainder of the specification, any number of first cylinder 120 with the appropriate other parts may be combined to form an engine.

Figure 17:
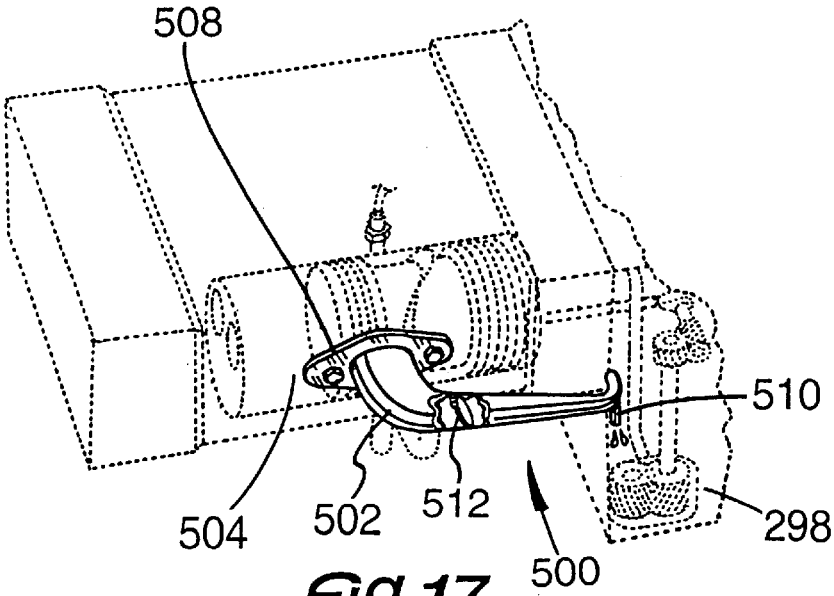
FIG. 17 depicts a perspective view of the double sided piston engine 100 of this invention, in partial cross-section, showing first external oil flow system 500.

The first external oil flow system 500 of FIG. 17 double sided piston engine 100 of this invention includes a flanged pipe 502 connected to the cylinder wall 504 in any cylinder, for example, first cylinder 120. Within cylinder wall 504 is an oil aperture 506. Flanged pipe 502 has a wall flange 508 secured around oil intake port 202 of FIG. 1 in order to provide communication for flanged pipe 502 with oil intake port 202. Oppositely disposed from wall flange 508 is sump end 510 for flanged pipe 502. Sump end 510 connects to the crankcase 298 (shown in FIG. 2) and permits oil recycling or circulation.

Also within first external oil flow system 500 is back flow prevention valve 512. Back flow prevention valve 512 is a one-way valve permitting oil to flow through flanged pipe 502 only from oil aperture 506 to sump end 510. In this fashion, oil is forced through the oil circulation system and whatever filtration system is associated therewith.

Figure 18:
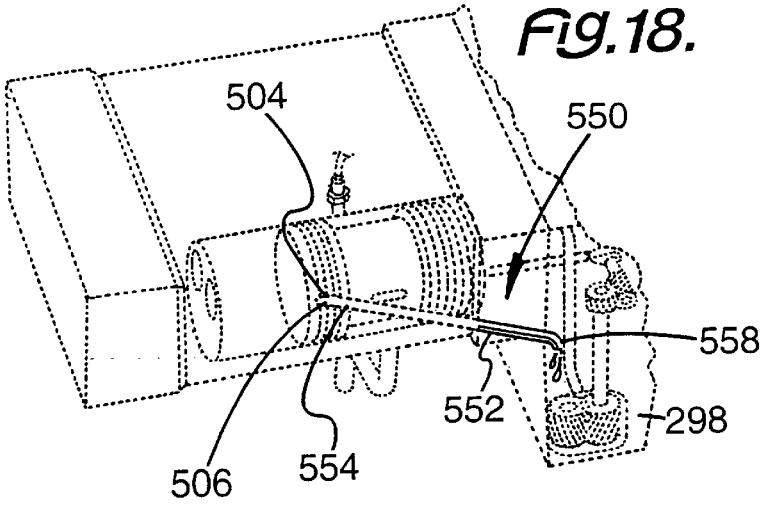
FIG. 18 depicts a perspective view of the double sided piston engine 100 of this invention, in partial cross-section, showing second external oil flow system 550.

While second external oil flow system 550 serves the same function as the other external oil flow systems, FIG. 18 depicts a straight oil tube 552 formed as an integral part of cylinder wall 504. Straight oil tube 552 has a solid cylinder end 554 secured in oil aperture 506, with an opposing drip end 558 situated in crankcase 298, in order to provide for oil circulation.

Figure 19:
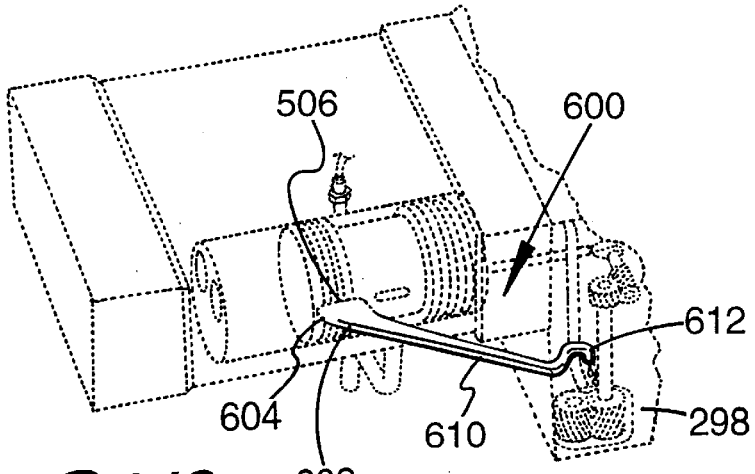
FIG. 19 depicts a perspective view of the double sided piston engine 100 of this invention, in partial cross-section, showing third external oil flow system 600.

Similarly, the third external oil flow system 600 of FIG. 19 has arced oil tube 602. The cylinder arc 604 at one end of arced oil tube 602 is connected to oil aperture 506 and communicates therewith. The cylinder arc 604 leads into straight tube 610, which, in turn, leads into arced sump end 612. Arc sump end 612 communicates with crankcase 298, in order to provide for oil circulation.

Figure 20:
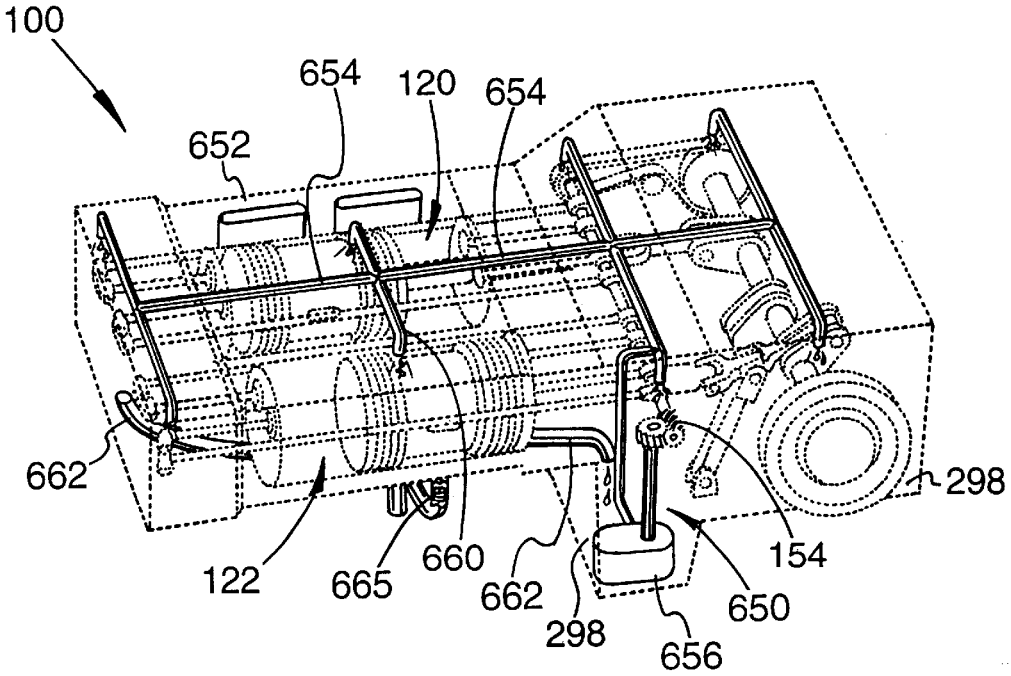
FIG. 20 depicts a perspective view of the double sided piston engine 100 of this invention, in partial cross-section, showing with oil pump assembly 650.

Combining FIG. 1 and FIG. 20, the effect of oil pump assembly 650 may be seen. Double sided piston engine 100 has an engine block 652 supporting first cylinder 120 and second cylinder 122. Associated therewith is oil pump assembly 650. In particular, a tubing array 654 permits oil to flow through all necessary parts of the engine block 652 thereby lubricating double sided piston engine 100.

In particular, oil pump 656 receives power from camshaft 154. Oil pump 656 drives oil to and through the array 654. Tee pipes 660 feed oil between first piston rings 182 and second piston rings 184, and provide lubrication therefor. Return pipe 662 accepts oil as the oil flows therefrom and permits oil to flow back to the crankcase 298. Within return pipe 662 is a pressure relief valve 665. Pressure relief valve 665 closes the engine 100 stops and prevents oil from leaving either first cylinder 120 or second cylinder 122. Upon starting the engine 100, pressure relief valve 665 opens and permits oil flow through the engine 100 in general. In this fashion, oil is maintained on the wearing parts of engine 100 at all times. Such a function provides a great improvement for the engine 100.

This application; taken as a whole with the specification, claims, abstract, and drawings; provides sufficient information for a person having ordinary skill in the art to practice the invention disclosed and claimed herein. Any measures necessary to practice this invention are well within the skill of a person having ordinary skill in this art after that person has made a careful study of this disclosure.

Because of this disclosure and solely because of this disclosure, modification of this method and apparatus can become clear to a person having ordinary skill in this particular art. Such modifications are clearly covered by this disclosure.

What is claimed and sought to be protected by Letters of the United States is:

1. An internal combustion engine having at least one cylinder with a reciprocating dual piston mounted therein, comprising:

the at least one cylinder providing a combustion assembly housing;

the reciprocating dual piston providing a set of combustion chambers within the at least one cylinder;

the set of combustion chambers including a first sub-chamber and a second sub-chamber within the cylinder;

the reciprocating dual piston dividing the at least one cylinder into the first sub-chanter and the second sub-chamber;

a connecting rod, a clevises link, a connecting shaft, and a rod bearing cooperating with the reciprocating dual piston;

the rod bearing being attachable to a crankshaft for a vehicle in order to provide power for the vehicle;

a support lever having a first lever end and a second lever end;

the first lever end being connected to the connecting shaft and the clevises link; and the second lever end being connected to a bearing.

2. The internal combustion engine of claim 1 further comprising:

the connecting rod having a connecting end attached to the reciprocating dual piston in the first combustion chamber;

the first combustion chamber being closer to the crankshaft than the second combustion chamber;

the connecting rod passing through a rod aperture in the first combustion chamber; and a slide fitting and bushing cooperating to movably seal the rod aperture around the connecting rod in order to seal the first sub-chamber.

3. The internal combustion engine of claim 2 further comprising:

the reciprocating dual piston and the connecting rod reciprocating in a substantially linear motion;

the reciprocating dual piston completing two separate strokes in two separate sub-chambers within the at least one cylinder; and a transfer mechanism converting the substantially linear motion into a rotational motion.

4. The internal combustion engine of claim 3 further comprising:

the transfer mechanism joining the connecting rod to a rotational motion of the crankshaft;

a clevises link attaching to the connecting rod;

a connecting shaft attaching to the clevises link with a dowel pin, a support lever, and a needle bearing;

the piston having a central portion between two end portions;

the diameter of a central portion is about ninety seven percent up to about one hundred percent of the diameter of the two end portions;

the connecting shaft rotating the crankshaft; and a bearing attaching the connecting shaft to the crankshaft.

5. A lubrication system for a reciprocating dual piston engine having at least one dual piston mounted in at least one cylinder of an engine block, comprising:

the at least one dual piston having a cylindrical portion and a rod portion;

the cylindrical portion having a central portion between two end portions;

the rod portion extending from the cylindrical portion;

an oil flow means being adapted to direct oil in an oil cycle to the central portion;

the oil flow means including an oil pump, an oil sump, at least one oil tubs and an oil reservoir;

the oil pump being adapted to collect oil from the oil sump and deliver oil to the oil reservoir in order to permit at least one repeat of the oil cycle;

the reciprocating dual piston engine having at least one dual piston;

a cylinder drain aperture being situated in the central portion;

the cylinder drain aperture cooperating with the oil flow means;

the rod Portion including a hollowed-out channel rod;

the hollowed-out channel rod communicating with the cylinder drain aperture;

a rod aperture in the hollowed-out channel rod communicating with an oil reservoir;

the oil reservoir communicating with the central portion;

an oil pump being situated adjacent to the central portion;

the oil pump moving oil from the oil reservoir into the central portion;

the at least one cylinder having an oil intake port communicating with the central portion in order to receive oil; and the at least one cylinder having an oil exit port communicating with the central portion in order to remove oil.

6. The lubrication system of claim 5 further comprising:

a flanged pipe being connected to a cylinder wall of the at least one cylinder;

the flanged pipe having a wall flange secured around an exit oil aperture in the cylinder wall in order to provide communication for the flanged pipe with the exit oil aperture;

the flanged pipe having a sump end oppositely disposed from wall flange; and the sump end being connectable to a crankcase for the reciprocating dual piston engine in order to permit oil recycling or circulation.

7. The lubrication system of claim 6 further comprising:

a back flow prevention valve being connected to the flanged pipe adjacent to the wall flange;

the back flow prevention valve permitting oil to flow out of reciprocating dual piston engine; and the back flow prevention valve preventing oil flow directly from the flanged pipe to the engine.

8. The lubrication system of claim 5 further comprising:

the cylinder having an oil exit aperture;

a straight oil tube communicating with the oil exit aperture at a first oil end thereof;

the straight oil tube having a drip end oppositely disposed from the first oil end; and the drip end communicating with a crankcase for the reciprocating dual piston engine.

9. The lubrication system of claim 5 further comprising;

an oil pump assembly operating the lubricating system;

a tubing array providing connection for the oil pump assembly to the cylinder;

the tubing array including a tee pipe for each at least one cylinder;

the tee pipe communicating with the central portion, in order to permit oil to flow through as necessary;

the oil pump assembly receiving power from the crankshaft;

the tubing array including a return pipe permitting oil to return to the crankcase; and a pressure relief valve releasably closing the return pipe as the engine stops, thereby keeping oil around the central portion.

10. An internal combustion engine having at least one cylinder with a reciprocating dual piston mounted therein, comprising:

the at least one cylinder providing a combustion assembly housing;

the reciprocating dual piston providing a set of combustion chambers within the at least one cylinder;

the set of combustion chambers including a first sub-chamber and a second sub-chamber within the cylinder;

the reciprocating dual piston dividing the at least one cylinder into the first sub-chamber and the second sub-chamber;

a connecting rod, a clevises link, a connecting shaft, and a rod bearing cooperating with the reciprocating dual piston;

the rod bearing being attachable to a crankshaft for a vehicle in order to provide power for the vehicle;

a support lever having a first lever end and a second lever end;

the first lever end being connected to the connecting shaft and the clevises link;

the second lever end being connected to a bearing;

the connecting rod having a connecting end attached to the reciprocating dual piston in the first combustion chamber;

the first combustion chamber being closer to the crankshaft than the second combustion chamber;

the connecting rod passing through a rod aperture in the first combustion chamber;

a slide fitting and bushing cooperating to movably seal the rod aperture around the connecting rod in order to seal the first sub-chamber;

the reciprocating dual piston and the connecting rod reciprocating in a substantially linear motion;

the reciprocating dual piston simultaneously completing two separate strokes in two separate sub-chambers within the at least one cylinder;

a transfer mechanism converting the substantially linear motion into a rotational motion;

the transfer mechanism joining the connecting rod to a rotational motion of the crankshaft;

a clevises link attaching to the connecting rod;

a connecting shaft attaching to the clevises link with a dowel pin, a support lever, and a needle bearing;

the piston having a central portion between two end portions;

the connecting shaft rotating the crankshaft;

a bearing attaching the connecting shaft to the crankshaft; and the central portion retaining oil therearound when the engine is shut off.

11. The internal combustion engine of claim 10 further comprising:

a first spark plug being mounted adjacent to a first end of the dual piston;

a second spark plug being mounted adjacent to a second end of the dual piston;

the first spark plug being in the first sub-chamber;

the second spark plug being in the second sub-chamber;

a piston rod being on the dual piston in the first sub-chamber;

a rocker arm connected adjacent to the second sub-chamber; and a pushrod connected to the rocker arm.

12. The internal combustion engine of claim 11 further comprising:

the dual piston having a substantially horizontal stroke;

a first pair of valves communicating with the first sub-chamber; and a second pair of valves communicating with the second sub-chamber.

13. The internal combustion engine of claim 12 further comprising:

the dual piston having a substantially horizontal stroke;

the piston rod being connected to a crankshaft through a yoke assembly;

the yoke assembly including a stabilizer yoke, a power yoke and stabilizer damper the stabilizer yoke being connected to the power yoke;

the power yoke and the stabilizer yoke both being connected to the stabilizer damper; and the power yoke being connected to the crankshaft.

14. The internal combustion engine of claim 13 further comprising:

the pushrod having a first end and a second end;

the rocker arm connecting the second pair of valves to the first end of the pushrod;

thus second end of the pushrod being connected to the crane camshaft;

the internal combustion engine having an engine block;

the engine block supporting each piston in its respective cylinder;

the engine block having an outboard head and an inboard head; and an exhaust manifold being positioned over the engine block between the outboard head and the inboard head.

15. The internal combustion engine of claim 14 further comprising:

a coolant jacket for the internal combustion engine;

a connecting shaft attaching the piston rod to the cam shaft at a first connecting shaft end;

a rod bearing supporting the connecting shaft;

the connecting shaft attaching to the clevises link at a second connecting shaft end; and the first connecting shaft end being oppositely disposed from the second connecting shaft end.

16. The internal combustion engine of claim 15 further comprising:

a coolant jacket for the internal combustion engine;

a dowel pin joining the second connecting shaft end to the clevises link;

the clevises link cooperating with the connecting rod and the second connecting shaft end in order to convert the linear motion of the dual piston and connecting rod into the rotational motion of the crankshaft;

a support lever attaching with the clevises link and the connecting shaft at a first support end;

the support lever having a needle bearing at a second support end of the support lever;

the needle bearing providing at a second support end of the support lever angular oscillation of the support lever.

17. The internal combustion engine of claim 16 further comprising:

the connecting rod having a connecting axis;

the connecting rod having a force vector along the connecting axis in order to efficiently extract force from the engine;

the crankshaft having a timing belt cooperating therewith; and the timing belt including a belt tension device in order to adjust the tension thereon.

* * * * *